US009927179B2

(12) United States Patent
Han et al.

(10) Patent No.: US 9,927,179 B2
(45) Date of Patent: Mar. 27, 2018

(54) HEAT EXCHANGE SYSTEM

(71) Applicant: Halla Visteon Climate Control Corp., Daejeon (KR)

(72) Inventors: Ji Hun Han, Daejeon (KR); Jae Yong Kim, Daejeon (KR); Hyuk Kim, Daejeon (KR); Eun Gi Min, Daejeon (KR); Seong-Oh Jeon, Daejeon (KR); Sun An Jeong, Daejeon (KR)

(73) Assignee: HANON SYSTEMS, Daejeon-si (KR)

( * ) Notice: Subject to any disclaimer, the term of this patent is extended or adjusted under 35 U.S.C. 154(b) by 126 days.

(21) Appl. No.: 14/652,130

(22) PCT Filed: Jan. 29, 2014

(86) PCT No.: PCT/KR2014/000881
§ 371 (c)(1),
(2) Date: Jun. 15, 2015

(87) PCT Pub. No.: WO2014/119942
PCT Pub. Date: Aug. 7, 2014

(65) Prior Publication Data

US 2015/0377558 A1 Dec. 31, 2015

(30) Foreign Application Priority Data

Feb. 1, 2013 (KR) ..... 10-2013-0011729
Jan. 28, 2014 (KR) ..... 10-2014-0010617

(51) Int. Cl.
*F28D 1/04* (2006.01)
*F28D 1/02* (2006.01)
(Continued)

(52) U.S. Cl.
CPC ..... *F28D 1/0233* (2013.01); *F28D 1/05358* (2013.01); *F28D 1/05391* (2013.01);
(Continued)

(58) Field of Classification Search
CPC ..... F28D 1/0233; F28D 1/05358; F28D 1/05391; F28D 1/022; F28D 1/045; F28D 1/128
(Continued)

(56) References Cited

U.S. PATENT DOCUMENTS

2005/0097746 A1 5/2005 Nozaki et al.
2007/0240865 A1* 10/2007 Zhang ..... F28D 1/0341 165/152
(Continued)

FOREIGN PATENT DOCUMENTS

JP 08178366 A 7/1996
JP 2010054115 A 3/2010
(Continued)

*Primary Examiner* — Davis Hwu
(74) *Attorney, Agent, or Firm* — Shumaker, Loop & Kendrick, LLP; James D. Miller

(57) ABSTRACT

Provided is a heat exchanger, and more particularly, a heat exchanger including a pair of header tanks formed in parallel, spaced apart from each other by a predetermined distance, a plurality of tubes having both ends fixed to the pair of header tanks to form a channel for a heat exchange medium; a plurality of fins fixed to abut between the tubes, and a plurality of louvers formed at the fins to contact air passing through the circumference of the fins, in which the louvers are formed to be asymmetrical to each other based on a center in a width direction of the fin or louver columns formed at one side or the other side of the fin in an asymmetrical form are alternately formed in a length direction of the fins to improve a flow of cooling air, thereby improving a heat radiation performance.

15 Claims, 12 Drawing Sheets

(51) Int. Cl.

| | |
|---|---|
| ***F28D 1/053*** | (2006.01) |
| ***F28F 1/02*** | (2006.01) |
| ***F28F 1/12*** | (2006.01) |
| ***F28F 1/04*** | (2006.01) |
| ***F28F 1/32*** | (2006.01) |
| *F28D 21/00* | (2006.01) |

(52) U.S. Cl.
CPC ..... *F28F 1/022* (2013.01); *F28F 1/045* (2013.01); *F28F 1/128* (2013.01); *F28F 1/325* (2013.01); *F28D 2021/0094* (2013.01)

(58) Field of Classification Search
USPC ..... 165/151
See application file for complete search history.

(56) References Cited

U.S. PATENT DOCUMENTS

| | | | | |
|---|---|---|---|---|
| 2009/0173478 | A1* | 7/2009 | Beamer | F25B 39/02 165/151 |
| 2011/0139414 | A1* | 6/2011 | Ghosh | F28F 1/128 165/151 |
| 2013/0299142 | A1* | 11/2013 | Yoshioka | F28D 1/05383 165/151 |

FOREIGN PATENT DOCUMENTS

| | | | |
|---|---|---|---|
| JP | 2011247539 | A | 12/2011 |
| JP | 2012154501 | A | 8/2012 |
| KR | 20020075659 | A | 10/2002 |

* cited by examiner

▶ wind velocity of 2 m/s

▶ wind velocity of 4 m/s

▶ wind velocity of 6 m/s

| | Temperature Distribution (center) | Temperature Distribution (Fin) |
|---|---|---|
| Related art |  |  |
| The present invention |  |  |

HEAT EXCHANGE SYSTEM

CROSS-REFERENCE TO RELATED APPLICATIONS

This application is a United States national phase application based on PCT/KR2014/000881 filed Jan. 29, 2014, which claims the benefit of Korean Patent Application No. 10-2013-0011729 Feb. 1, 2013 and 10-2014-0010617 dated Jan. 28, 2014.

TECHNICAL FIELD

The present invention relates to a heat exchanger, and more particularly, to a heat exchanger including a pair of header tanks formed in parallel, spaced apart from each other by a predetermined distance, a plurality of tubes having both ends fixed to the pair of header tanks to form a channel for a heat exchange medium; a plurality of fins fixed to abut between the tubes, and a plurality of louvers formed at the fins to contact air passing through the circumference of the fins, in which the louvers are formed to be asymmetrical to each other based on a center in a width direction of the fin or louver columns formed at one side or the other side of the fin in an asymmetrical form are alternately formed in a length direction of the fins to improve a flow of cooling air, thereby improving a heat radiation performance.

BACKGROUND ART

A heat exchanger is an apparatus which absorbs heat from one environment and discharges the absorbed heat to the other environment between the two environments having a temperature difference and acts as a cooling system in the case in which the heat exchanger absorbs heat from the interior of a room and discharges the absorbed heat to the outside and a heating system in the case in which the heat exchanger absorbs heat from the outside and discharges the absorbed heat to the interior of a room.

Further, in a vehicle equipped with an internal combustion engine, a general water-cooled heat exchanger is mounted in the vehicle to cool the engine. The water-cooled heat exchanger includes a water pump which circulates cooling water around a cylinder block and a cylinder head to reduce the temperature thereof and includes a radiator, a cooling fan, a thermostat, and the like for heat radiation of the cooling water.

As illustrated in FIG. 1, the heat exchanger is configured to include a header tank 2 in and from which a heat exchange medium flows and is discharged and in which the heat exchange medium flows, a plurality of tubes 4 connected to the header tank 2 to form a channel for a heat exchange medium, and a plurality of fins 5 fixedly abut between the tubes 4. Further, the fin 5 is formed between the tubes 4 in a corrugated form to be assembled between the tubes 4 and then bonded therebetween by brazing to increase a contact area with air passing between the tubes 4. Therefore, heat exchange efficiency between the heat exchange medium which flows along an inside of the tubes 4 and air therearound is increased.

Further, the fin 5 is configured to be provided with a plurality of louvers 6 as illustrated in FIG. 2 to maximally increase the contact area with the cooling air, thereby maximizing the heat exchange efficiency between the heat exchange medium flowing in the tube 4 and cooling air passing through the circumference of the fin 5.

As illustrated in FIGS. 2 and 3, the louvers 6 are molded by cutting the fins 5 and then folding the cut portions and are formed to be spaced apart from each other at a predetermined distance along a flow direction of the cooling air and are formed to protrude to both surfaces of the fins 5. However, centers of the louvers 6 are provided with center banks 5*a*, and the louvers 6 of both sides are symmetrically formed to each other based on the center banks 5*a* and the number of louvers 6 is equally formed.

However, in order to form the louver 6 by cutting and then folding the fin 5, the number of louvers 6 of both sides needs to be symmetrically formed to each other based on the center bank 5*a* in terms of manufacturing characteristics and since a width of the fin 5 is limited, it is difficult to increase the number of louvers and thus it is difficult to improve heat exchange performance. That is, the heat exchange performance is increased only when the number of louvers 6 is increased. A specific width for each heat exchanger 1 is defined and thus it is difficult to increase the number of louvers 6 within the limited width of the fin 5.

Further, in order to improve a pressure resisting quality due to the cooling air of the fins 5 and the louvers 6 coupled between the tubes 4, there is a need to increase support strength between the tubes 4 by widening the width of the center bank 5*a*, increasing a thickness of the fin 5, and the like. However, it is difficult to improve the pressure resisting quality due to the cooling air while improving the heat exchange performance.

Further, both ends of the fin 5 are provided with side support parts 5*b* and a width of the side support part 5*b* is formed to be larger than that of the center bank 5*a*. In this case, since the heat exchange is less generated at the side support part 5*b* having a plane shape formed in parallel with an inflow direction of the cooling air than at the louver 6, the side support part 5*b* needs to be formed to have a much larger width at the side in which the cooling air flows and therefore the heat exchange efficiency may be reduced.

As the related art associated with this, Japanese Patent Laid-Open Publication No. 2010-054115 entitled "evaporator" is disclosed.

RELATED ART DOCUMENT

Patent Document (Patent Document 1) JP 2010-054115 A (Mar. 11, 2010)

Technical Problem

An object of the present invention is to provide a heat exchanger in which a center bank is formed to be eccentric based on a center in a width direction of a fin and the number of louvers of both sides is formed to be different based on the center bank to improve a flow of cooling air, thereby improving heat radiation performance of the heat exchanger.

Technical Solution

In one general aspect, a heat exchanger includes a pair of header tanks 100 formed in parallel, spaced apart from each other by a predetermined distance; a plurality of tubes 200 having both ends fixed to the pair of the header tanks 100 to form a channel for a heat exchange medium; a plurality of fins 300 fixed to abut between the tubes 200; and a plurality of louvers 400 formed at the fins 300, in which center banks 500 are formed between the louvers 400 formed at the fins 300 and are formed to be eccentric based on a center in a width direction of the fin 300 to make the number of louvers 400 of both sides be differently formed to each other based on the center bank 500 and make directions of the louvers 400 of both sides be formed to be opposite to each other based on the center bank 500.

Based on the center bank 500, the number of louvers 400 disposed at one side where a temperature difference $\Delta T$ between air passing through a circumference of the louver 400 and a heat exchange medium flowing in the tube 200 is large may be more than the number of louvers disposed at the other side.

The louvers 400 may be formed to have the same pitch $P_L$, and directions of the louvers 400 of both sides may be formed to be opposite to each other based on the center bank 500 and inclined angles of the louvers 400 to the width direction of the fin 300 may be equally formed.

Both ends in the width direction of the fin 300 may be provided with side support parts 510 and a width $W_B$ of the center bank 500 may be formed to be larger than a width $W_S$ of the side support parts 510.

One end in the width direction of the fin 300 may be provided with a display unit 310.

A first louver column 410 in which the center bank 500 is eccentric to one side based on the center in the width direction of the fin 300 and a second louver column 420 in which the center bank 500 is eccentric to the other side may be alternately arranged in parallel along the length direction of the fin 300.

A pair of the first louver columns 410 in which the center bank 500 is eccentric to one side based on the center in the width direction of the fin 300 and a pair of the second louver columns 420 in which the center bank 500 is eccentric to the other side may be alternately arranged to each other along the length direction of the fin 300.

A distance $L_B$ between the center of the center bank 500 of the first louver column 410 and the center of the center bank 500 of the second louver column 420 may be formed to be one time or more and three times or less ($P_L \times 1 \leq L_B \leq P_L \times 3$) as large as the pitch $P_L$ of the louver 400.

The width $W_B$ of the center bank 500 may be formed to be a multiple ($W_B = P_L \times$ integer) of the pitch $P_L$ of the louver 400.

The width of the center bank 500 of the first louver column 410 and the width of the center bank 500 of the second louver column 420 may be formed to overlap each other in the width direction of the fin 300.

The width of the center bank 500 of the first louver column 410 and the width of the center bank 500 of the second louver column 420 may be formed so as not to overlap each other in the width direction of the fin 300.

Based on the center banks 500, an angle $\alpha$ of the louver 400 of the side where the number of louvers 400 is small may be equal to or larger than (angle $\alpha \geq$ angle $\beta$) an angle $\beta$ of the louver 400 of the side where the number of louvers 400 is large and when the angle $\alpha$ is larger than the angle $\beta$, the louvers 400 may be formed to meet the following Equation.

$$0.9 \times \sin\alpha \times \text{the number of louvers (small side)} \leq \sin\beta \times \text{the number of louvers (large side)} \leq 1.1 \times \sin\alpha \times \text{the number of louvers (small side)}$$

Advantageous Effects

According to the heat exchanger according to the embodiment of the present invention, the center bank may be formed to be eccentric based on the center in the width direction of the fin and the number of louvers of both sides may be formed to be different based on the center bank to improve the flow of cooling air, thereby improving heat radiation performance of the heat exchanger.

Further, the strength supporting the tube and the fin may be improved by the center bank eccentrically formed to improve the durability against the flow pressure of the cooling air.

DESCRIPTION OF DRAWINGS

The above and other objects, features and advantages of the present invention will become apparent from the following description of preferred embodiments given in conjunction with the accompanying drawings, in which.

BEST MODE

A heat exchanger according to an embodiment of the present invention to achieve the above objects will be described below in detail with reference to the accompanying drawings.

Figure 1:
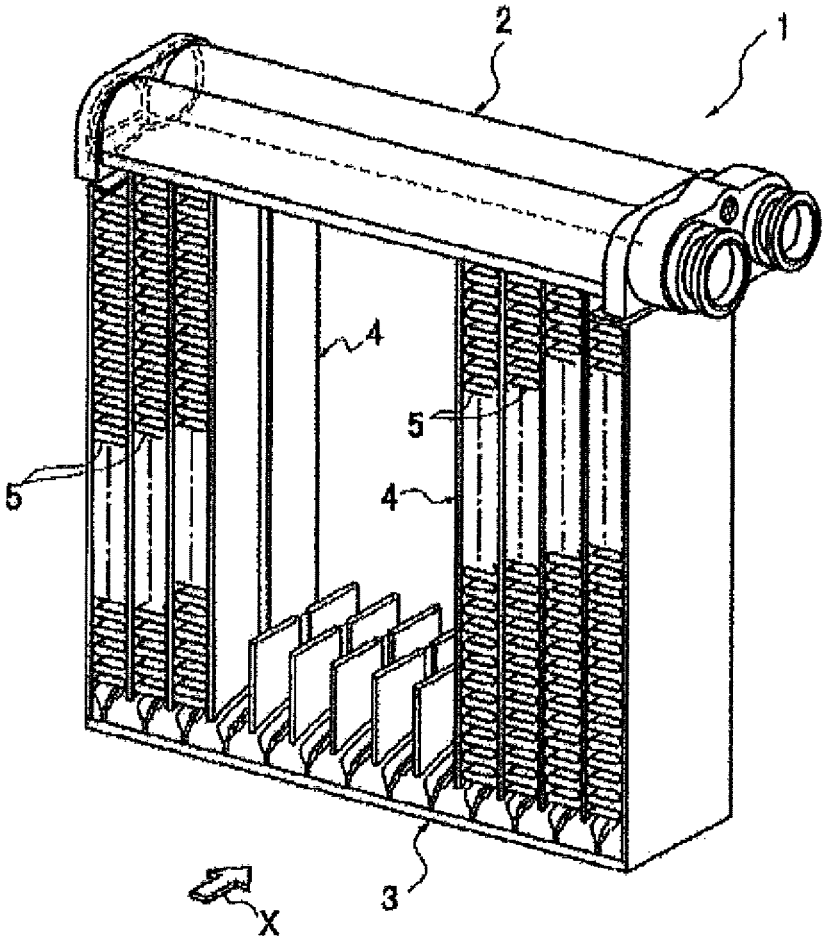
FIG. 1 PRIOR ART
FIGS. 1 to 3 are a perspective view and a partial perspective view and illustrating a heat exchanger according to the related art and a cross-sectional view of a louver.
Figure 2:
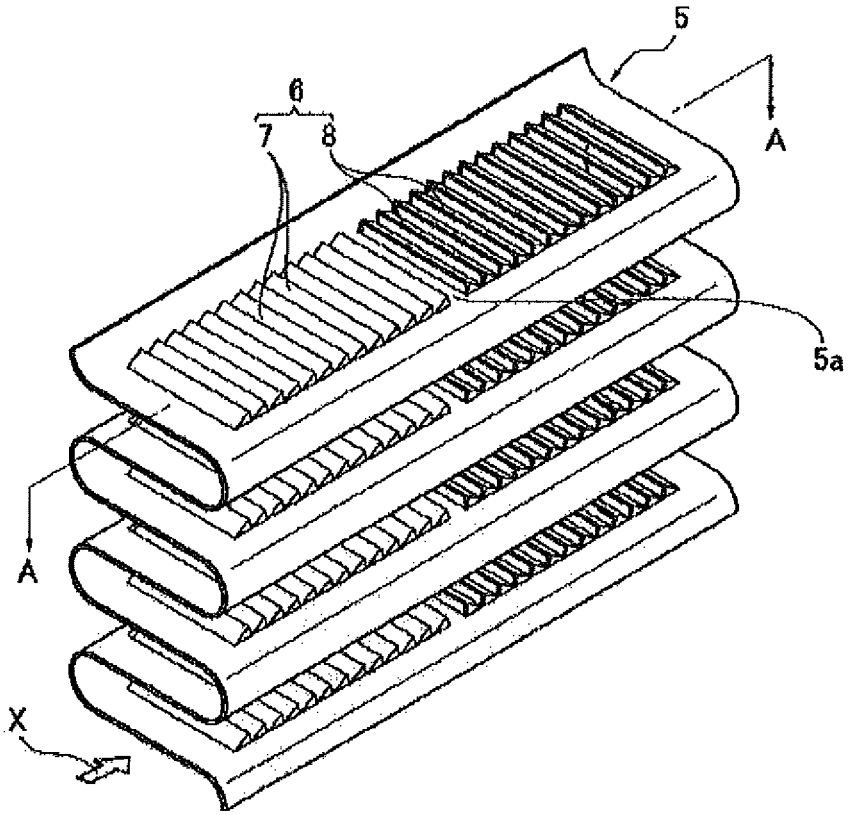
FIG. 2 PRIOR ART
Figure 3:
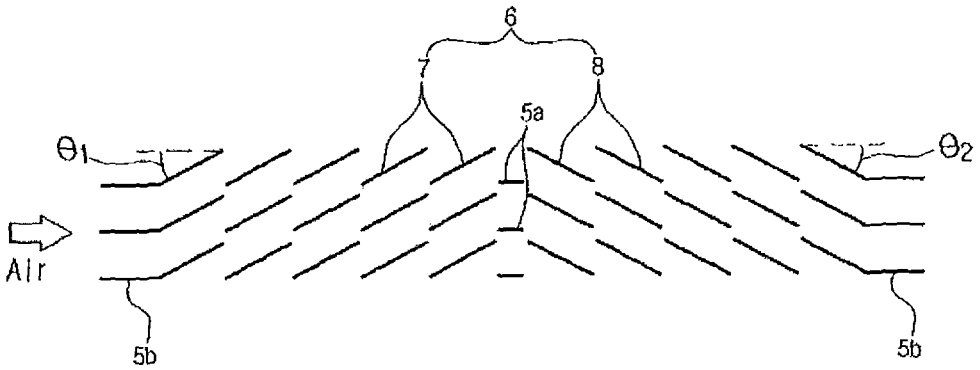
FIG. 3 PRIOR ART
Figure 4:
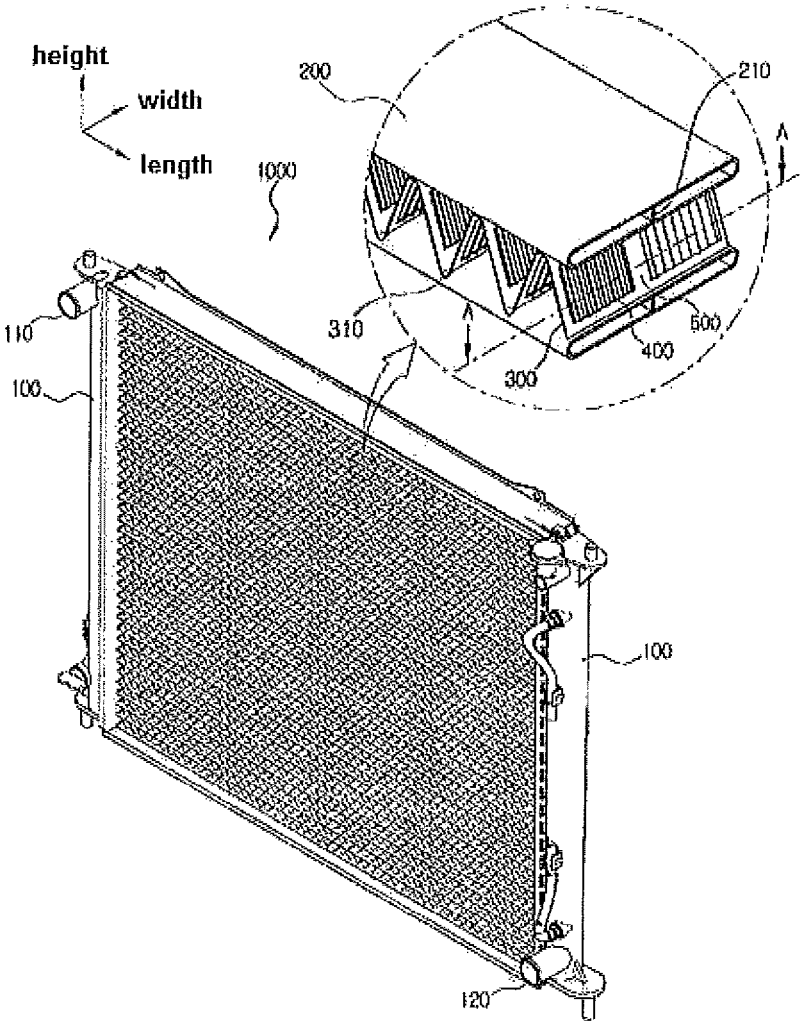
FIG. 4 is a perspective view illustrating a heat exchanger according to an embodiment of the present invention.
Figure 5:
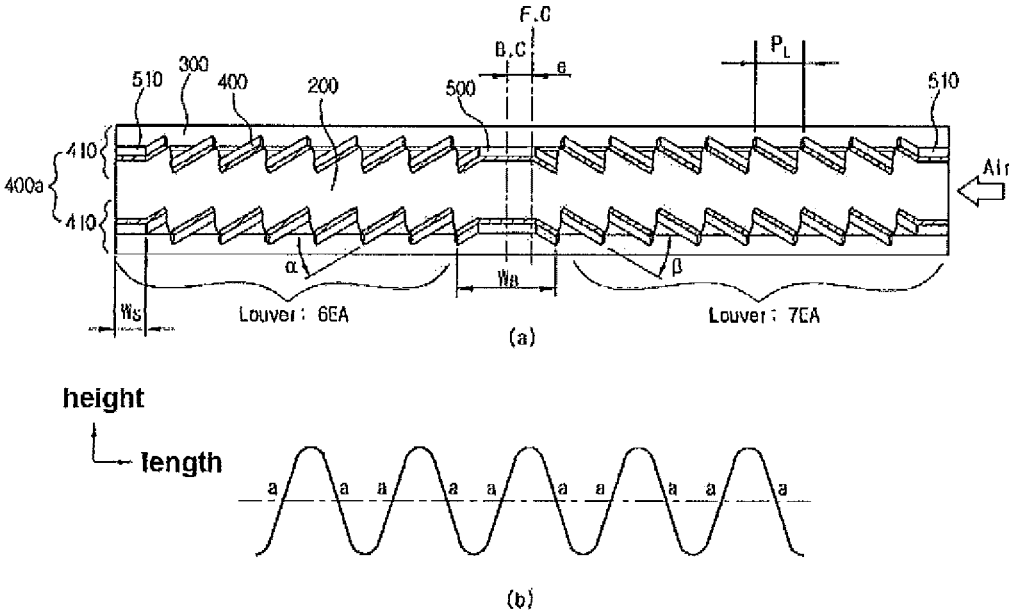
FIG. 5 is a cross-sectional view of a louver and a center bank according to a first embodiment of the present invention taken along the direction AA' and a front view schematically illustrating a fin.

FIG. 4 is a perspective view illustrating a heat exchanger according to an embodiment of the present invention and FIG. 5 is a cross sectional view of a louver and a center bank according to a first embodiment of the present invention.

As illustrated, a heat exchanger 1000 according to an embodiment of the present invention is configured to include: a pair of header tanks 100 formed in parallel, spaced apart from each other by a predetermined distance; a plurality of tubes 200 having both ends fixed to the pair of the header tanks 100 to form a channel for a heat exchange medium; a plurality of fins 300 fixed to abut between the tubes 200; and a plurality of louvers 400 formed at the fins 300, in which center banks 500 are formed between the louvers 400 formed at the fins 300 and are formed to be eccentric based on a center in a width direction of the fin 300 to make the number of louvers 400 of both sides be differently formed from each other based on the center bank 500 and make directions of the louvers 400 of both sides be formed to be opposite to each other based on the center bank 500.

First, the header tanks 100 have an inside formed with a space in which the heat exchange medium is stored and flows and is formed in pair, spaced apart from each other at a predetermined distance. Further, the header tanks 100 are provided with an inlet pipe 110 in which a heat exchange medium flows and an outlet pipe 120 through which the heat exchange medium is discharged.

The tube 200 has both ends fixed to the pair of header tanks 100 and communicates with the header tanks 100 to form a channel for a heat exchange medium.

The fin 300 is interposed between the tubes 200 and abuts to the tubes 200 and is fixed by brazing, and the like, such that the fin 300 receives heat from the heat exchange medium flowing in the tube 200 and discharges the heat to the outside.

In this case, the fin 300 is folded in a corrugated form or a zigzag form to widen a heat radiation area. According to the embodiment of the present invention, as the fins 300, a corrugate fin 300 having a mountain and a valley formed by continuously folding a sheet may be used.

Further, the fin 300 is provided with the plurality of louvers 400, in which the louver 400 is formed in plural at a predetermined distance along a flow direction of cooling air and vents having a slot form are formed between the louvers 400 and the cooling air passes therebetween to increase heat exchange efficiency.

Further, the louvers 400 are formed to protrude to both surfaces of the fin 300 by cutting and then folding a portion of the fin 300 and are formed to have a predetermined angle to the fin 300 to switch a flow direction of the cooling air passing through the circumference of the fin 300 or increase a heat radiation area, thereby improving the heat exchange efficiency.

Here, as illustrated in FIG. 5A, the fin 300 is provided with the plurality of louvers 400 in parallel in a width direction and the center bank 500 is formed between the louvers 400. In this case, the center bank 500 is formed to be eccentric (e) based on a center F.C. in the width direction of the fin 300 and the number of louvers 400 formed at both sides in a width direction is differently formed from each other based on the center bank 500. Further, directions of the louvers 400 of both sides are formed to be opposite to each other based on the center bank 500.

That is, the center bank 500 is not formed at the center F.C. in the width direction of the fin 300 and is formed to be eccentric to one side to make the number of louvers 400 of both sides in the width direction be differently formed and when the louvers 400 formed left based on the center bank 500 are formed to be inclined counterclockwise based on the fin 300, the louvers 400 formed right are formed to be inclined clockwise based on the fin 300.

In this case, a louver column 400*a* which is one column in which the plurality of louvers 400 and center banks 500 are formed may be formed in the fin 300 so that the center bank 500 is eccentric to one side based on the center F.C. of the fin 300. That is, as illustrated in FIG. 5B, a first louver column 410 (type a) in which the center bank 500 is eccentric left based on the center F.C. of the fin may be formed.

As the result, the flow of cooling air passing between the fin 300 and the louver 400 of the heat exchanger is improved and thus a coefficient of heat transfer is improved, thereby improving the heat exchange performance of the heat exchanger 1000.

As described above, according to the heat exchanger 1000 according to the embodiment of the present invention, the center bank 500 may be formed to be eccentric based on the center F.C. in the width direction of the fin and the number of louvers 400 of both sides may be formed to be different based on the center bank 500 to improve the flow of cooling air, thereby improving heat radiation performance of the heat exchanger 1000.

Further, when the center bank 500 is manufactured to be eccentric to one side, the number of louvers 400 of both sides may be differently formed based on the center bank 500. That is, when the total number of louvers 400 formed in one column is 12 (even number), five louvers may be formed at one side and seven louvers may be formed at the other side. Further, when the total number of louvers 400 is 13, six louvers may be formed at one side and seven louvers may be formed at the other side.

Therefore, the number of louvers 400 is formed in an odd number (13 numbers) rather than forming the total number of louvers 400 in an even number (12 numbers) by forming six louvers 400 equally at both sides based on the center bank 500 within a defined width of the fin 300 and the center bank 500 is eccentric to one side in the width direction to make six louvers 400 be formed at one side and seven louvers 400 be formed at the other side, thereby improving the heat exchange performance.

This may be confirmed from data of the coefficient of heat transfer which are measured by an experiment and it is confirmed that the coefficient of heat transfer is improved as much as 6.1% and 6.5% in the case in which the number of left and right louvers 400 is differently formed than in the case in which the number of left and right louvers 400 is the same when a wind velocity of cooling air is 4 m/s and 6 m/s.

Further, based on the center bank 500, the number of louvers 400 disposed at one side where a temperature difference $\Delta T$ between air passing through the circumference of the louver 400 and the heat exchange medium flowing in the tube 200 is large may be more than the number of louvers 400 disposed at the other side.

The reason is that the louvers 400 are more formed at the side in which the cooling air flows in the width direction of the fin 300 and thus the heat exchange is more rapidly made at the side where the temperature difference $\Delta T$ is large to improve the heat exchange efficiency. That is, the cooling air heat exchanges with the heat exchange medium flowing in the tube 200 while flowing in the width direction of the fin 300 and thus the temperature of the cooling air rises. Therefore, the louvers 400 are more formed at the side in which the low temperature cooling air flows to make the heat exchange faster.

Further, the louvers 400 are formed to have the same pitch $P_L$, and directions of the louvers 400 of both sides are formed to be opposite to each other based on the center bank 500 and inclined angles $\alpha$, $\beta$ of the louvers to the width direction of the fin 300 may be equally formed.

That is, the pitch $P_L$ of the louvers 400 is formed to be equal and the inclined directions of the louvers 400 of both sides may be different based on the center bank 500 but the size of the inclined angle may be formed to be equal, such that a form roll for forming the louver 400 at the fin 300 may be easily manufactured.

Further, both ends in the width direction of the fin 300 are provided with side support parts 510 and a width $W_B$ of the center bank 500 may be formed to be larger than a width $W_S$ of the side support parts 510.

An end in the width direction of the fin 300 which is a portion in which the cooling air flows is provided with the side support part 510, the width $W_S$ of the side support part 510 is formed to be smaller, the width $W_B$ of the center bank 500 is formed to be relatively larger. Therefore, due to the center bank 500, the support strength between the tubes 200 is improved and the durability against the flow pressure of the cooling air is improved, and the end in the width direction of the fin 300 which is the portion in which the cooling air flows is provided with the side support part 510 so that the width of the side support part 510 is small and therefore the louver 400 may be disposed to be closer to the portion where the temperature difference ΔT between the cooling air and the heat exchange medium is largest as much, thereby improving the heat exchange efficiency.

Further, one end in the width direction of the fin 300 may be provided with a display unit 310.

When for the overall louver column 400*a*, the center bank 500 is formed to be eccentric to one side from the center in the width direction of the fin 300, the end in the width direction of the fin 300 of the side where the number of louvers 400 is large or the side where the number of louvers 400 is small is provided with the display unit 310 to differentiate the direction in which the cooling water flows. In this case, the direction in which the cooling air flows may be selected as the direction in which the measured coefficient of heat transfer of the heat exchanger is large and the cooling air may inflow from the side where the number of louvers 400 is small but the cooling air may inflow from the side where the number of louvers 400 is large. Further, the display unit 310 is formed as a protrusion which protrudes to one end in the width direction of the fin 300, a concave groove, or the like to be easily differentiated.

Further, the first louver column 410 in which the center bank 500 is eccentric to one side based on the center F.C. in the width direction of the fin 300 and the second louver columns 420 in which the center bank 500 is eccentric to the other side may be alternately arranged in parallel along the length direction of the fin 300.

Figure 6:
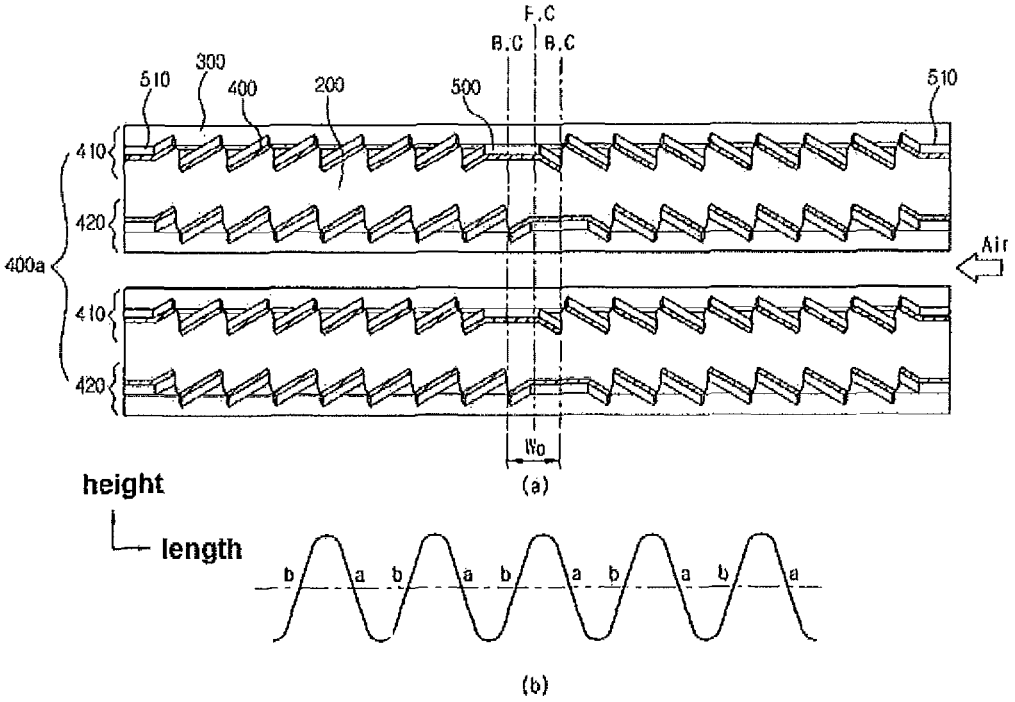
FIGS. 6 and 7 are cross-sectional views of a louver and a center bank according to second and third embodiments of the present invention taken along the direction AA' and front views schematically illustrating a fin.

That is, as illustrated in FIG. 6A, among the plurality of louver columns 400*a* formed in parallel, spaced apart from each other at a predetermined distance along the length direction of the fin 300, the first louver column 410 in which the center bank 500 is eccentric to one side based on the center F.C. in the width direction of the fin 300 and the second louver column 420 in which the center bank 500 is eccentric to the other side are formed to be alternately arranged to each other along the length direction and as illustrated in FIG. 6B, the first louver column 410 (type a) in which the center bank 500 is eccentric left based on the center F.C. of the fin and the second louver column 420 (type b) in which the center bank 500 is eccentric right may be configured to be alternately disposed to each other.

Therefore, as described above, in the case in which the louver columns 400*a* are alternately formed, it is possible to prevent the fin 300 from being folded to one side when the louvers 400 are formed by cutting and folding the fin 300, such that the fin 300 may be easily manufactured. That is, when the fin 300 is cut and folded, since the number of left and right louvers 400 is different based on the portion where the center bank 500 is formed and thus the number of cut and folded slits is different, the force of the form roll for forming the louvers 400 applied to the left and right of the fin 300 is different and thus the fin 300 may be folded to one side.

Figure 8:
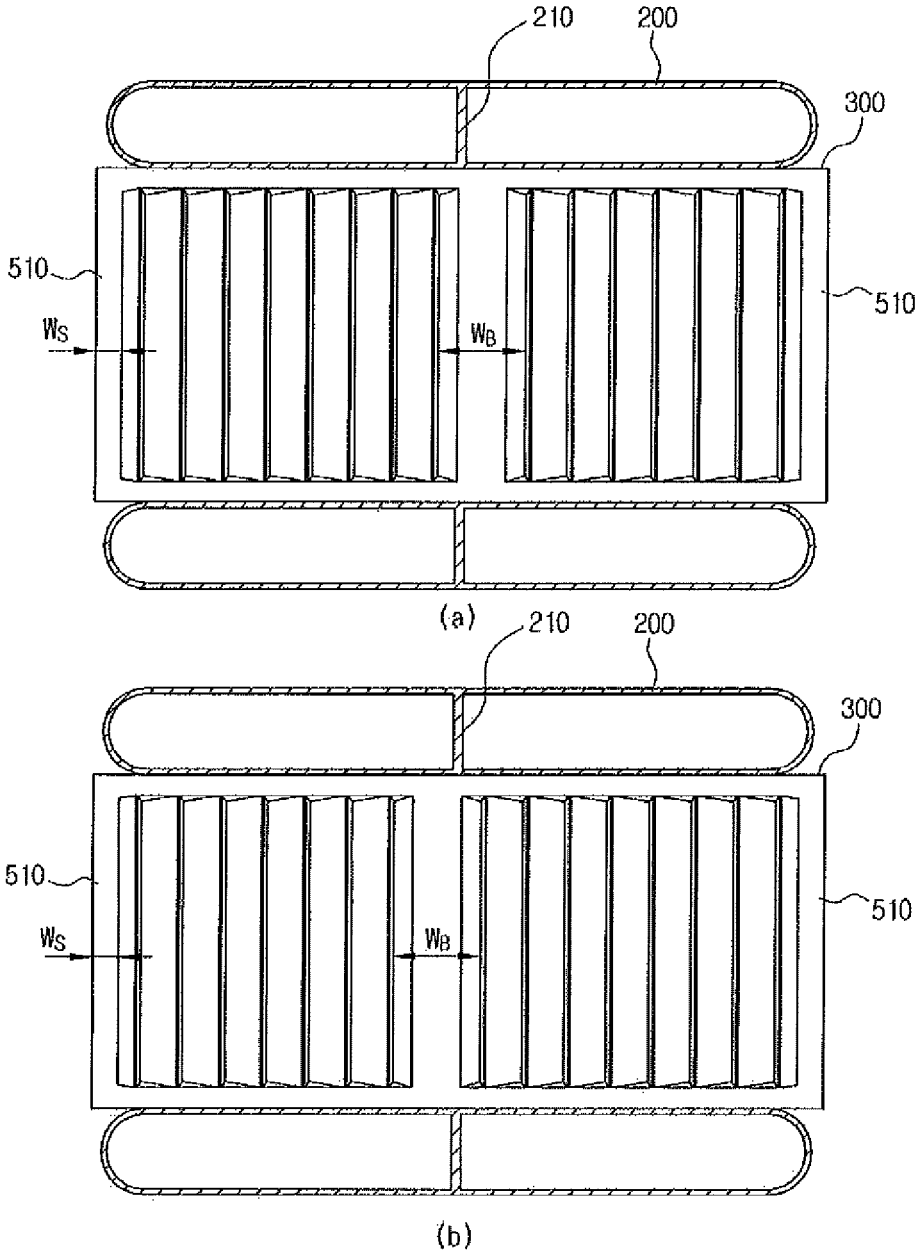
FIG. 8 is a side cross-sectional view illustrating the louver and the center bank according to the embodiment of the present invention.

In this case, as described above, when the first louver column 410 and the second louver column 420 in which the center bank 500 is differently eccentric in the width direction are arranged to be alternate to each other, as illustrated in FIG. 8, the width of the center bank 500 supporting between the tubes 200 may be widened and thus the support strength between the tubes 200 and the fin 300 is improved, thereby improving the durability against the flow pressure of the cooling air.

Therefore, it is possible to improve the support strength between the tubes 200 while improving the heat exchange performance without widening the width of each center bank 500, increasing the thickness of the fin, or the like.

Further, a pair of first louver columns 410 in which the center bank 500 is eccentric to one side based on the center in the width direction of the fin 300 and a pair of the second louver columns 420 in which the center bank 500 is eccentric to the other side may be alternately arranged to each other along the length direction of the fin 300.

Figure 7:
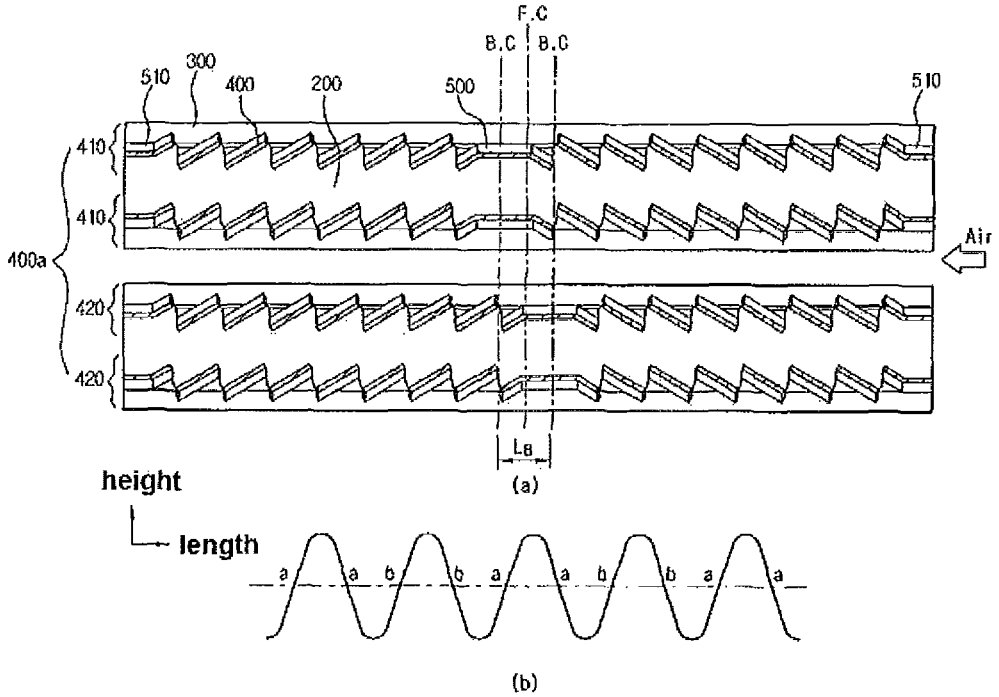

That is, as illustrated in FIG. 7A, the first louver column 410 in which the center bank 500 is eccentric to one side in the width direction and the second louver column 420 in which the center bank 500 is eccentric to the other side are formed in pair to be alternately arranged to each other and as illustrated in FIG. 7B, the pair of first louver columns 410 (type a) in which the center bank 500 is eccentric left based on the center F.C. of the fin and the pair of second louver columns 420 (type b) in which the center bank 500 is eccentric right may be configured to be alternately arranged to each other.

Therefore, when the louvers 400 are formed by cutting and folding the fin 300, it is possible to prevent the fin 300 from being folded to one side and thus the fin 300 may be easily manufactured. Further, the louvers 400 may be formed two by two columns, meeting the diameter of the form roll for forming the louver 400 by cutting and folding the fin 300. That is, since it is difficult to form the diameter of the form roll at a specific size or less and therefore the louver 400 and the center bank 500 may be formed in a form in which the louvers 400 are alternate two by two columns, meeting the diameter of the form roll.

Further, a distance $L_B$ between the center B.C. of the center bank 500 of the first louver column 410 and the center B.C. of the center bank 500 of the second louver column 420 may be formed to be one time or more and three times or less ($P_L \times 1 \leq L_B \leq P_L \times 3$) as large as the pitch $P_L$ of the louver 400.

Figure 9:
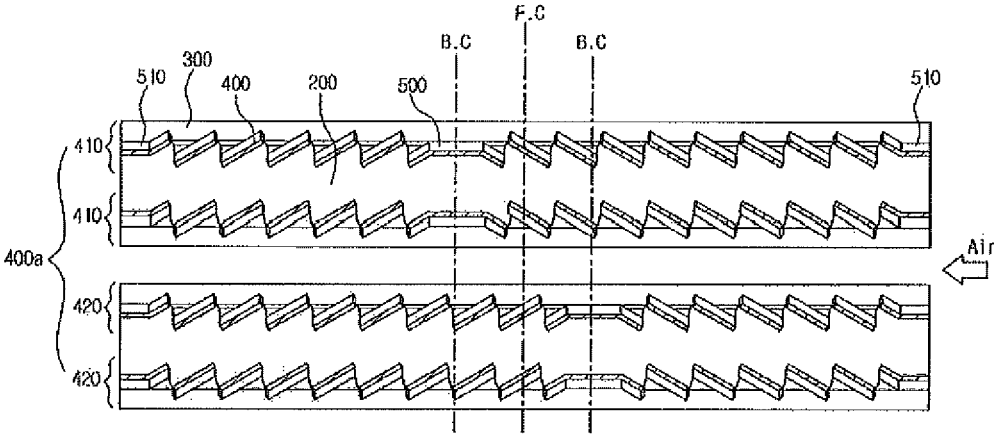
FIG. 9 is a cross-sectional view illustrating a louver and a center bank according to a fourth embodiment of the present invention.

The distance $L_B$ in the width direction of the centers B.C. of the center banks 500 of the first louver column 410 and the second louver column 420 alternately arranged as illustrated in FIG. 9 is formed to be one time or more and three times or less than the pitch $P_L$ of the louver 400. That is, when the distance $L_B$ in the width direction of the center B.C. of the center banks 500 is formed to be at least one time or more than the pitch $P_L$ of the louver 400 and thus it may be easy to make the number of louvers 400 of both sides based on the center bank 500 be differently formed while the width and the pitch of the louver 400 are the same. Further, in the case in which the eccentric amount of the center bank 500 is large, the fin 300 is deformed by being folded as described above when the louver 400 is formed and therefore the distance between the center banks 500 to be eccentric may be formed to be three times or less than the louver pitch.

Further, the width $W_B$ of the center bank 500 may be formed to be a multiple ($W_B = P_L \times$ integer) of the pitch $P_L$ of the louver 400.

This is to easily manufacture a blade of the form roll for forming the louver 400 in the fin 300 by forming the width $W_B$ of the center bank 500 at the multiple ($W_B$=$P_L$×integer) at the pitch $P_L$ of the louver 400. That is, the interval between the slits for manufacturing the louver 400 may be constant and thus the form roll may be easily manufactured.

Further, the width of the center bank 500 of the first louver column 410 and the width of the center bank 500 of the second louver column 420 may be formed to overlap each other in the width direction of the fin 300.

Further, the width of the center bank 500 of the first louver column 410 and the width of the center bank 500 of the second louver column 420 may be formed so as not to overlap each other in the width direction of the fin 300.

That is, the eccentric distance of the center bank 500 of the first louver column 410 and the center bank 500 of the second louver column 420 is small and thus the center banks 500 may be formed so that a region (overlapping width $W_O$ of the center banks) overlapping in the width direction of the fin 300 is present and the eccentric distance of the center banks 500 is large and thus the center banks 500 may be formed so that the overlapping region $W_O$ is not present.

Further, the center in the width direction of the inside of the tube 200 may be provided with a reinforcing rib 210. As illustrated in FIG. 8, the center bank 500 supports between the tubes 200 and the reinforcing rib 210 formed at the center inside the tube 200 supports the tube 200, such that the reinforcing rib 210 may support a vertical load applied to the center bank 500 by the flow pressure of the cooling air.

Therefore, the durability against the flow pressure of the cooling air of the fins and the louvers may be improved.

Further, based on the center banks 500, an angle α of the louver 400 of the side where the number of louvers 400 is small is equal to or larger than (angle α angle β) an angle β of the louver 400 of the side where the number of louvers 400 is large and when the angle α is larger than the angle β, the louvers 400 may be formed to meet the following Equation:

$$0.9\times\text{Sin}\ \alpha\times\text{the number of louvers (small side)}\leq\sin\beta\times\text{the number of louvers (large side)}\leq 1.1\times\text{Sin}\ \alpha\times\text{the number of louvers (small side)}$$

That is, based on the center bank 500, the flow of the cooling air of the side where the number of louvers 400 is small and the flow of the cooling air of the side where the number of louvers 400 is large are different and therefore the angle α of the side where the number of louvers 400 is small and the angle β of the side where the number of louvers 400 is large are formed to be different from each other to smooth the flow of the cooling air, thereby improving the heat exchange performance.

Figure 10:
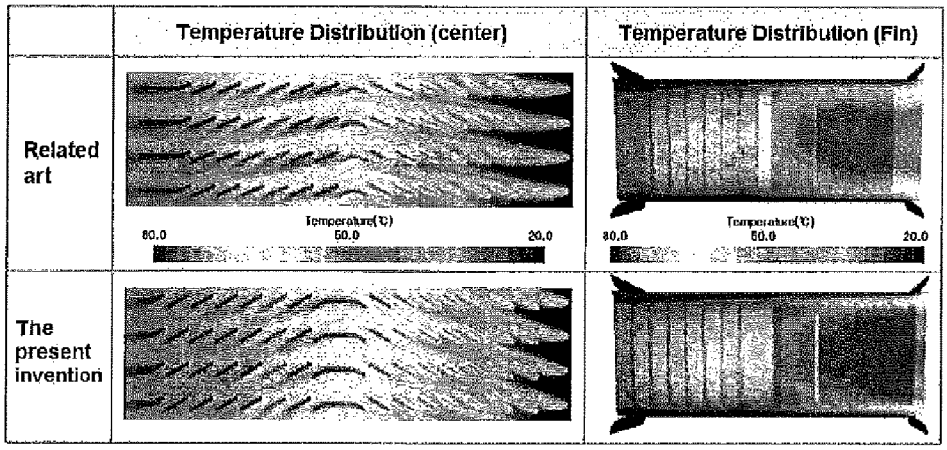
FIGS. 10 to 12 are photographs illustrating a temperature distribution of the direction AA' and a temperature distribution of a fin viewed from a side at wind velocities of cooling air of 2 m/s, 4 m/s, and 6 m/s in the case of using the heat exchanger according to the embodiment of the present invention.
Figure 11:
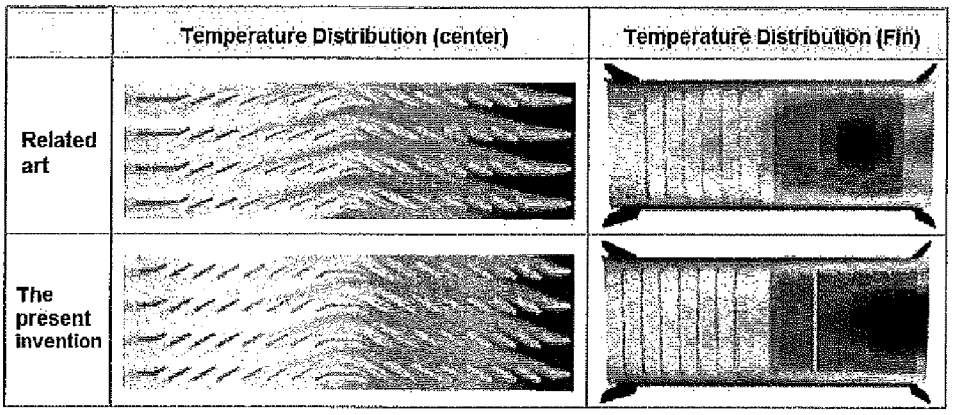
Figure 12:
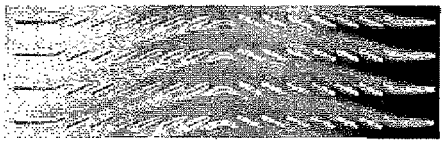
Figure 12:
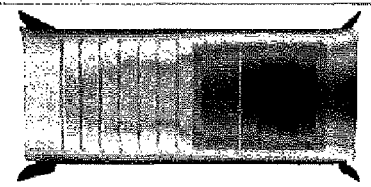
Figure 12:
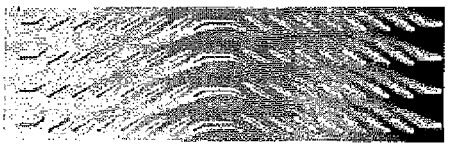
Figure 12:
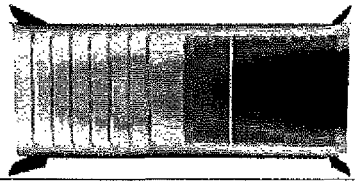

Further, FIGS. 10 to 12 are photographs illustrating a temperature distribution of the direction AA' and a temperature distribution of a fin viewed from a side at wind velocities of cooling air of 2 m/s, 4 m/s, and 6 m/s in the case of using the heat exchanger according to the embodiment of the present invention.

As illustrated, it may be appreciated that when considering the temperature distribution in the section AA' of the fin 300, in the case of the present invention, the portion represented by dark blue is small at the right which is the inflow side of the cooling air. That is, it may be appreciated that the present invention more actively generates the heat exchange at the inflow side of cooling air to increase the cooling efficiency.

Figure 13:
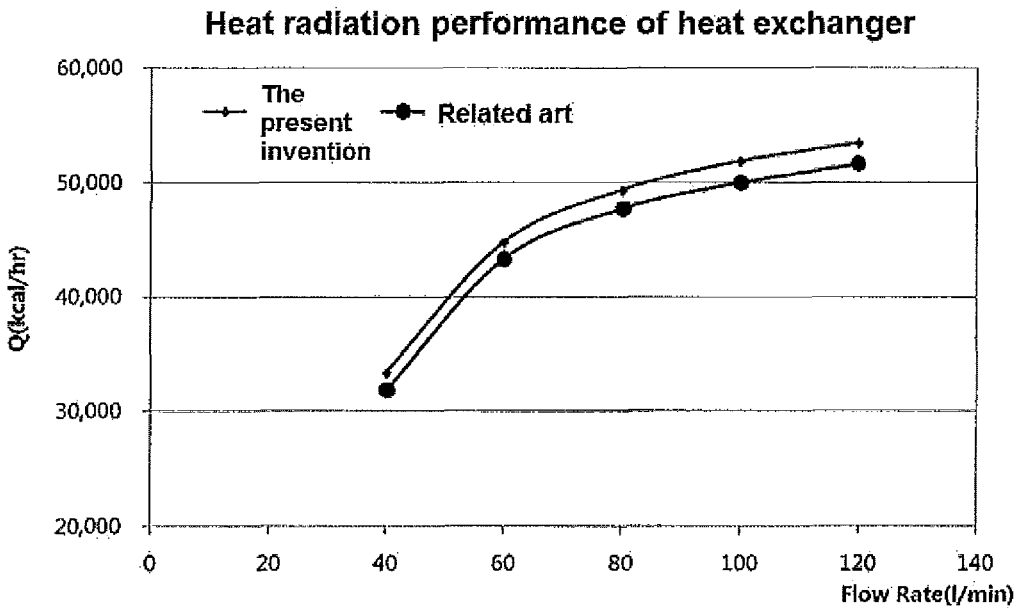
FIG. 13 is a comparison graph of heat radiation performance of the heat exchanger of the related art and the present invention depending on a flow rate of a heat exchange medium at a wind velocity of cooling air of 6 m/s.

FIG. 13 is a comparison graph of heat radiation performance of the heat exchanger of the related art and the present invention depending on a flow rate of a heat exchange medium at a wind velocity of cooling air of 6 m/s.

As illustrated, it is shown that the heat radiation performance Q (vertical axis) of the heat exchanger according to the embodiment of the present invention is superior to that of the related art over the overall area of the flow rate (horizontal axis) of the heat exchange medium flowing in the tube 200 of the heat exchanger 1000.

Further, the heat exchanger 1000 according to the embodiment of the present invention may be a tube type beat exchanger in a form in which it is configured of the tube formed by extruding or folding and welding, the fin 300 having both ends fixed to the pair of header tanks 100 and fixed to abut between the tubes 200, and the louvers 400 formed to protrude to the fins 300 and a stacked tube type (plate type) heat exchanger in a form in which the tubes 200 are coupled with a pair of plates (not shown) and the plurality of tubes 200 are stacked.

The present invention is not limited to the above-mentioned embodiments but may be variously applied, and may be variously modified by those skilled in the art to which the present invention pertains without departing from the gist of the present invention claimed in the claims.

DETAILED DESCRIPTION OF MAIN ELEMENTS

1000: (The present invention) Heat exchanger
100: Header tank
110: Inlet pipe
120: Outlet pipe
200: Tube
210: Reinforcing rib
300: fin
310: Display unit
400: Louver
400*a*: Louver column
410: First louver column
420: Second louver column
500: Center bank
510: Side support part
$W_B$: Width of center bank
$W_S$: Width of side support part
$W_O$: Overlapping width of center banks
$P_L$: Pitch of louver
α: Angle of louver of side where the number of louvers is small
β: Angle of louver of side where the number of louvers is large
F.C: Central line of fin
B.C: Central line of center bank
$L_B$: Distance between central lines of center bank
e: Eccentricity

The invention claimed is:

1. A heat exchanger comprising:

a pair of header tanks formed in parallel, spaced apart from each other by a predetermined distance;

a plurality of tubes having ends fixed to the pair of the header tanks to form a channel for a heat exchange medium; and a plurality of fins abutting the tubes, the fins having a plurality of louvers formed therein, wherein the louvres are formed in a first louvre column and a second louvre column formed parallel to the first louvre column, wherein the first louvre column includes a center bank formed between the louvres of the first louvre column and the second louvre column includes a center bank formed between the louvres of the second louvre column, wherein a center of the center bank of the first louvre column is offset to a first side of a center of the fin with respect to a width of the fin and a center of the center bank of the second louvre column is offset to a second side of the center of the fin with respect to the width of the fin, a first quantity of louvers formed on a first side of the center bank of the first louvre column different from a second quantity of louvers formed on a second side of the center bank of the first louvre column and a direction of the louvers on the first side of the center bank of the first louvre column formed to be opposite a direction of the louvers formed on the second side of the center bank of the first louvre column, a first quantity of louvers formed on a first side of the center bank of the second louvre column different from a second quantity of louvers formed on a second side of the center bank of the second louvre column and a direction of the louvers on the first side of the center bank of the second louvre column formed to be opposite a direction of the louvers formed on the second side of the center bank of the second louvre column, wherein the first louvre column and the second louvre column are alternately arranged along a length direction of the fin.

2. The heat exchanger of claim 1, wherein the first quantity of louvers of the first louvre column is greater than the second quantity of louvers of the first louvre column, and wherein the louvres of the first louvre column on the first side of the center bank of the first louvre column are disposed where a temperature difference between air passing through a circumference of the louvers and the heat exchange medium flowing in the tube is at a maximum.

3. The heat exchanger of claim 1, wherein a pitch of the louvers and incline angles of the louvers are equal.

4. The heat exchanger of claim 1, wherein ends of each of the fins are provided with side support parts, and wherein a width of the center bank of the first louvre column and the center bank of the second louvre column of each of the fins is greater than a width of the side support parts.

5. The heat exchanger of claim 1, wherein one end in the width direction of the fin is provided with a display unit.

6. The heat exchanger of claim 1, wherein a distance between the center of the center bank of the first louvre column and the center of the center bank of the second louvre column is formed to be between one and three times a pitch of the louvers.

7. The heat exchanger of claim 1, wherein a width of the center bank of the first louvre column in the width direction of the fin and a width of the center bank of the second louvre column in the width direction of the fin are each a multiple of a pitch of the louvers.

8. The heat exchanger of claim 1, wherein a width of the center bank of the first louvre column and a width of the center bank of the second louvre column overlap each other in the width direction of the fin.

9. The heat exchanger of claim 1, further comprising a pair of the first louver columns and a pair of the second louver columns, the pair of the first louver columns alternately arranged with the pair of the second louver columns along the length direction of the fin.

10. The heat exchanger of claim 1, wherein a width of the center bank of the first louvre column and a width of the center bank of the second louvre column do not to overlap each other in the width direction of the fin.

11. The heat exchanger of claim 1, wherein a first angle $\alpha$ of the louvers formed on the second side of the center bank of the first louvre column is equal to or greater than a second angle $\beta$ of the louvers formed on the first side of the center bank of the first louvre column, and wherein the louvers are formed according to the following equation:

$$0.9\times\text{Sin}\ \alpha\times\text{the second quantity of louvers}\leq\sin\beta\times\text{the first quantity of louvers}\leq 1.1\times\text{Sin}\ \alpha\times\text{the second quantity of louvers.}$$

12. The heat exchanger of claim 9, wherein a distance between the center of the center bank of each of the pair of the first louvre columns and the center of the center bank of each of the pair of the second louvre columns is formed to be between one and three times a pitch of the louvers.

13. The heat exchanger of claim 9, wherein a width of the center bank of each of the pair of the first louvre columns in the width direction of the fin and a width of the center bank of each of the pair of the second louvre columns in the width direction of the fin are each a multiple of a pitch of the louver.

14. The heat exchanger of claim 9, wherein a width of the center bank of each of the pair of the first louvre columns and a width of the center bank of each of the pair of the second louvre columns overlap each other in the width direction of the fin.

15. The heat exchanger of claim 9, wherein a width of the center bank of each of the pair of the first louvre columns and a width of the center bank of each of the pair of the second louvre columns do not to overlap each other in the width direction of the fin.

* * * * *